US005873632A

United States Patent [19]

Chieh-Tsung

[11] Patent Number: 5,873,632

[45] Date of Patent: Feb. 23, 1999

[54] PILLOW AND BACKREST OF CHAIR

[75] Inventor: Lu Chieh-Tsung, Taichung, Taiwan

[73] Assignee: Aur Hann Co., Ltd., Taichung, Taiwan

[21] Appl. No.: 55,393

[22] Filed: Apr. 6, 1998

[51] Int. Cl.[6] ..... A47C 7/38

[52] U.S. Cl. ..... 297/404; 297/408

[58] Field of Search ..... 297/284.3, 285, 297/291, 292, 296, 297, 299, 301.3, 391, 404, 408, 452.49, 216.12

[56] References Cited

U.S. PATENT DOCUMENTS

| | | | |
|---|---|---|---|
| 2,833,339 | 5/1958 | Liljengren | 297/452.49 X |
| 4,564,235 | 1/1986 | Hatsutta et al. | 297/284.4 |
| 4,810,033 | 3/1989 | Kemmann | 297/284.4 |
| 4,844,544 | 7/1989 | Ochiai | 297/408 |

FOREIGN PATENT DOCUMENTS

| | | | |
|---|---|---|---|
| 138726 | 9/1934 | Austria | 297/285 |
| 60898 | 9/1941 | Denmark | 297/292 |
| 2068718 | 8/1981 | United Kingdom | 297/284.4 |

*Primary Examiner*—Peter R. Brown
*Attorney, Agent, or Firm*—Harrison & Egbert

[57] ABSTRACT

A chair is composed of a seat, a backrest, a headrest, and a swiveling device located between the backrest and the headrest so as to cause the backrest and the headrest to swivel relative to each other in response to the sitting posture of a person who is seated on the seat of the chair. The swiveling device has a tubular member, two volute elastic plate members, a connection rod, and a plurality of elastic members.

4 Claims, 9 Drawing Sheets

PILLOW AND BACKREST OF CHAIR

FIELD OF THE INVENTION

The present invention relates generally to a chair, and more particularly to a headrest and a backrest of the chair.

BACKGROUND OF THE INVENTION

The conventional office chairs are generally provided with a fixed headrest and a backrest which is seldom found to be useful by the office workers. The fixed headrest can not adjusted to suit a user's need.

SUMMARY OF THE INVENTION

The primary objective of the present invention is to provide a chair with an adjustable headrest and an improved backrest. The objective, features and functions of the present invention will be readily understood upon a thoughtful deliberation of the following detailed description of the present invention with reference to the accompanying drawings.

DETAILED DESCRIPTION OF THE INVENTION

Figure 1:
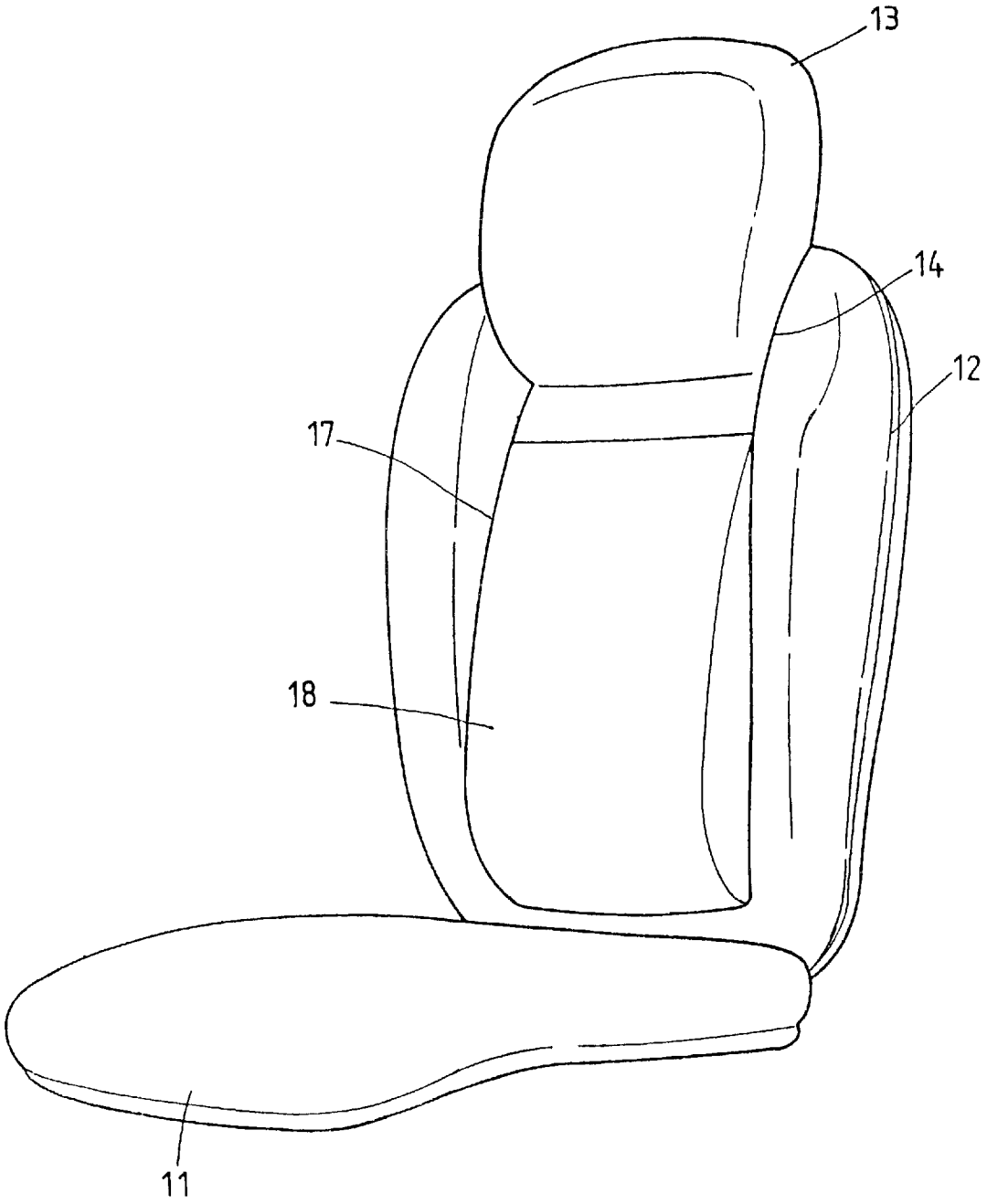
FIG. 1 shows a perspective view of the present invention.

As shown in FIG. 1, a chair embodied in the present invention is composed of a seat 11, a backrest 12, and a headrest 13. The headrest 13 is fastened at the lower end thereof with a recess 14 by a swiveling device 20, thereby enabling the headrest 13 to swivel relative to backrest.

Figure 2:
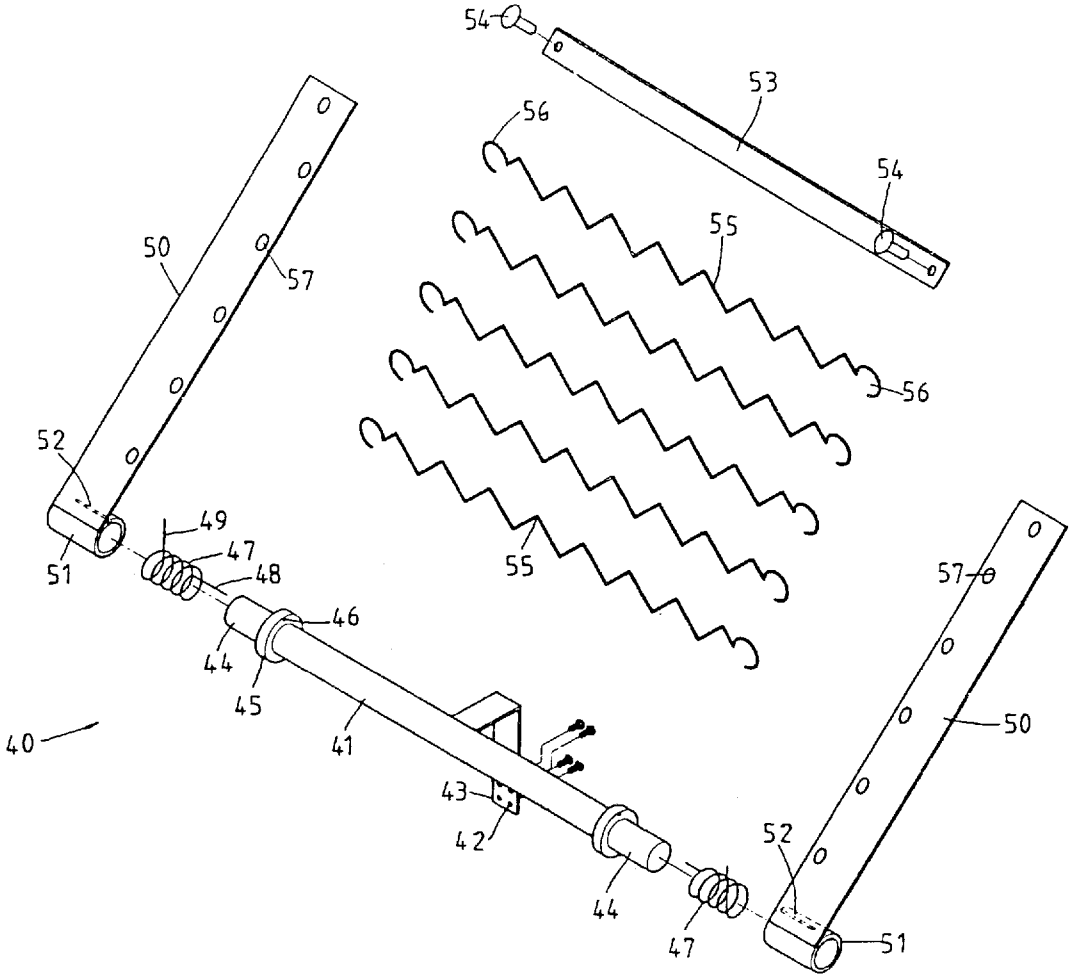
FIG. 2 shows an exploded view of a swiveling device of the headrest portion of the present invention.
Figure 3:
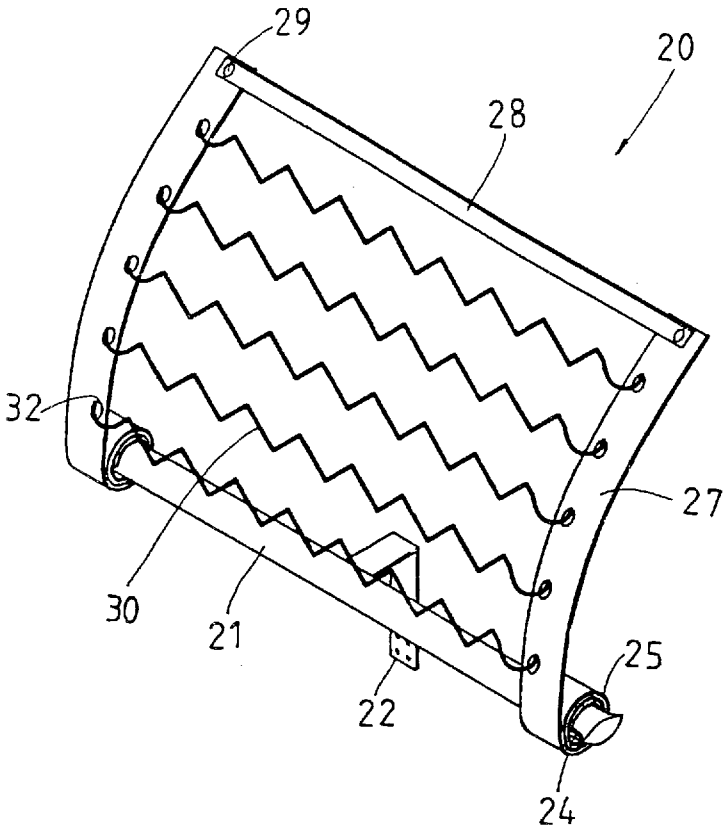
FIG. 3 shows a perspective view of the swiveling device of the headrest portion of the present invention in combination.

The swiveling device 20 comprises the component parts, which are described hereinafter with reference to FIGS. 2 and 3.

A tubular member 21 is provided with a bracing plate 22 fastened thereto by welding. The bracing plate 22 is inserted into a back plate 15 of the backrest 12. The back plate 15 is fastened by a fastening screw 16 which is engaged with a threaded hole 23 of the bracing plate 22. The tubular member 21 is provided respectively at both ends thereof with a holding slot 24.

Two volute elastic plate members 25 have an end plate section 26 which is located in the holding slot 24 of the tubular member 21, and an arcuate plate section 27.

A connection rod 28 is fastened with the arcuate plate section 27 by a rivet 29.

A plurality of elastic members 30 are provided respectively at both ends thereof with a hooked portion 31 which is engaged with a retaining hole 32 of the arcuate plate section 27.

Figure 4:
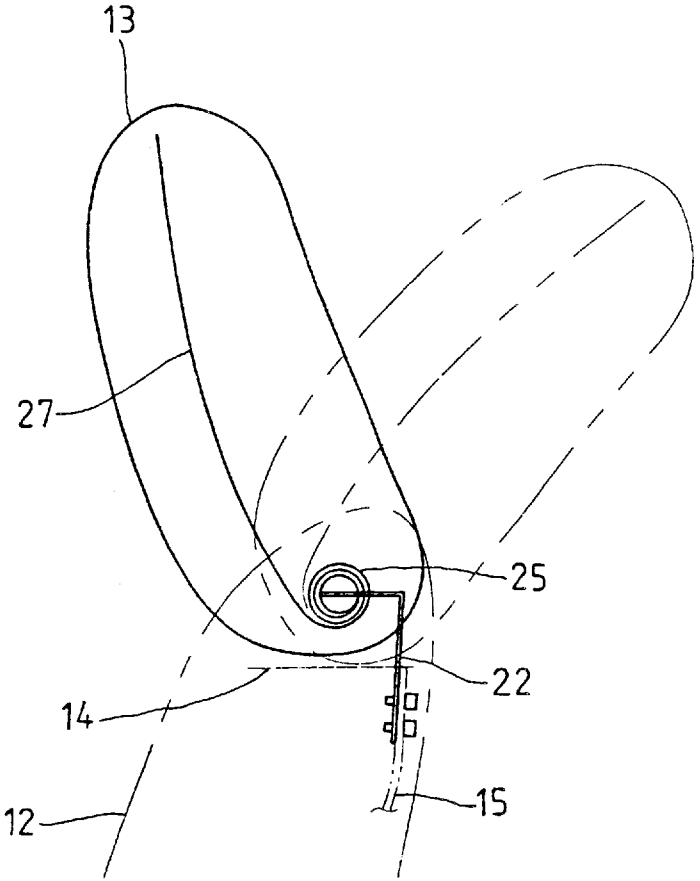
FIG. 4 shows a side schematic view of the swiveling device of the headrest portion of the present invention.
Figure 7:
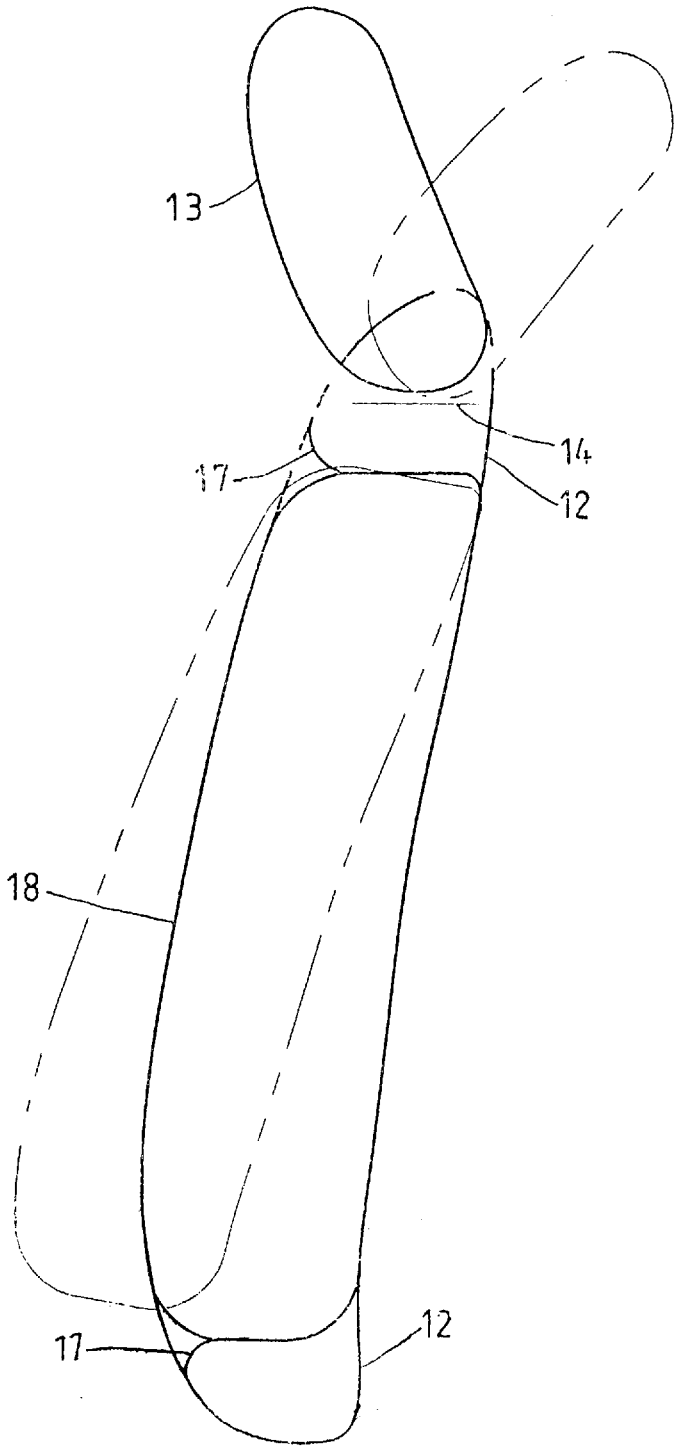
FIG. 7 shows a side schematic view of the present invention.

The swiveling device 20 enables the headrest to swivel relative to the backrest 13 whenever the pillow 13 is acted on by the force of the head of a person seated on the seat 11, as illustrated in FIGS. 4 and 7.

Figure 5:
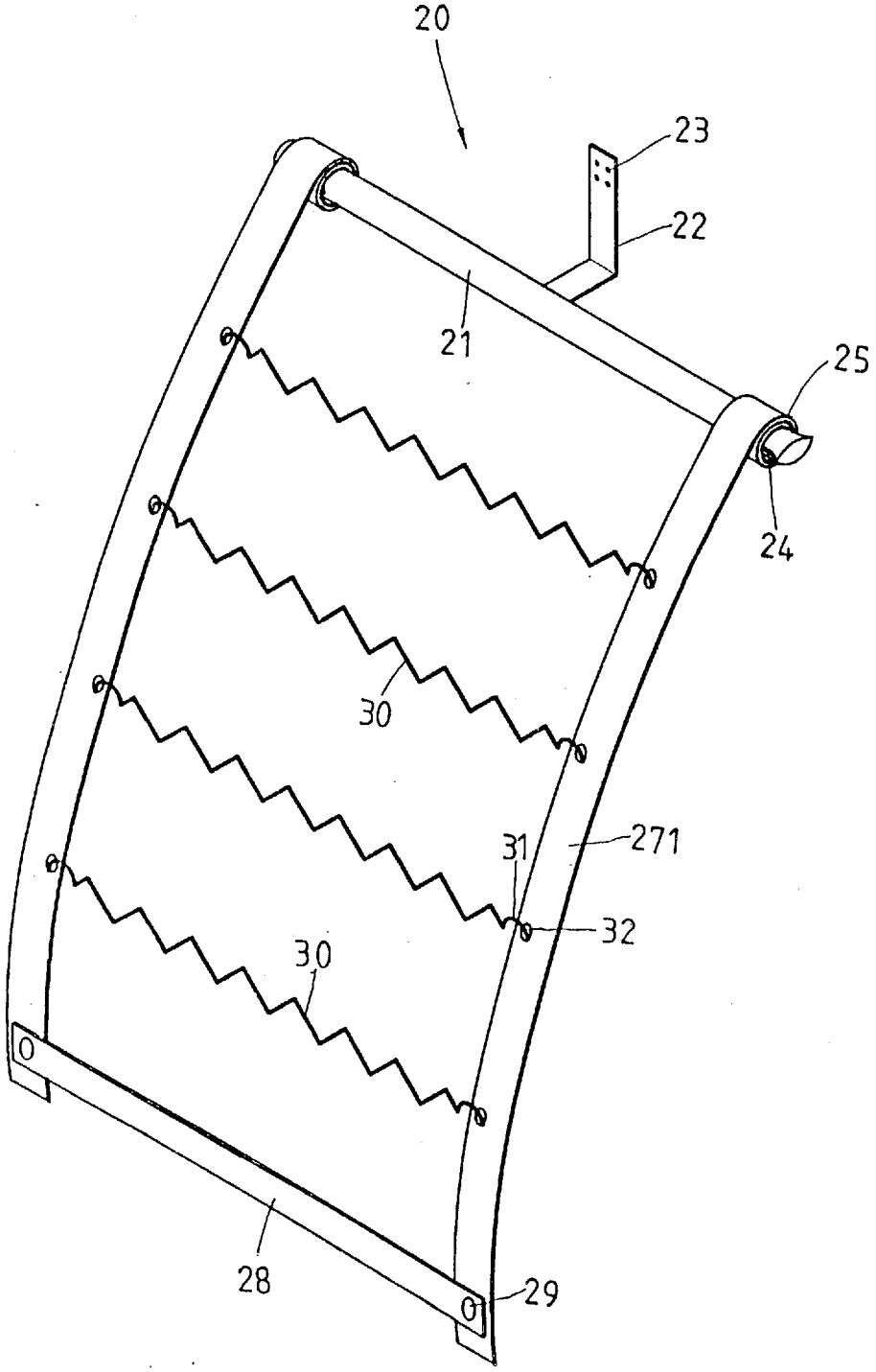
FIG. 5 shows a perspective view of a swiveling device of the backrest of the present invention.
Figure 6:
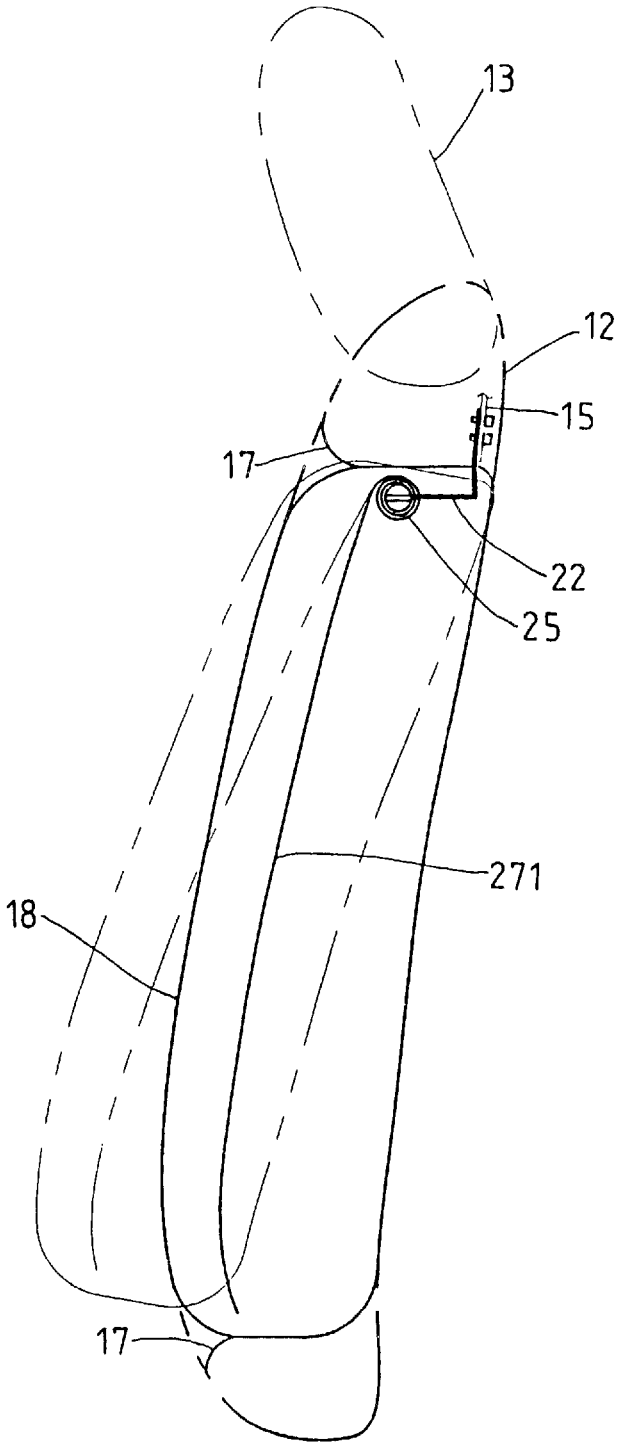
FIG. 6 shows a side schematic view of the swiveling device of the backrest of the present invention.

As shown in FIGS. 5 and 6, the backrest 12 is provided in the center thereof with a slotted frame 17, which is fastened at an edge thereof with a backrest pad 18 in conjunction with the swiveling device 20. The volute elastic plate members 25 of the swiveling device 20 are provided with a waist plate section 271 similar in profile to the backrest pad 18. The bracing plate 22 of the tubular member 21 is located in front of the edge of the back plate 15 of the backrest 12 such that the bracing plate 22 is fastened by the fastening screw 16 which is engaged with the threaded hole 23 of the bracing plate 22. The backrest pad 18 is capable of swiveling relative to the headrest 13 in accordance with the sitting posture of a person seated on the seat 11, as illustrated in FIGS. 6 and 7.

Figure 8:
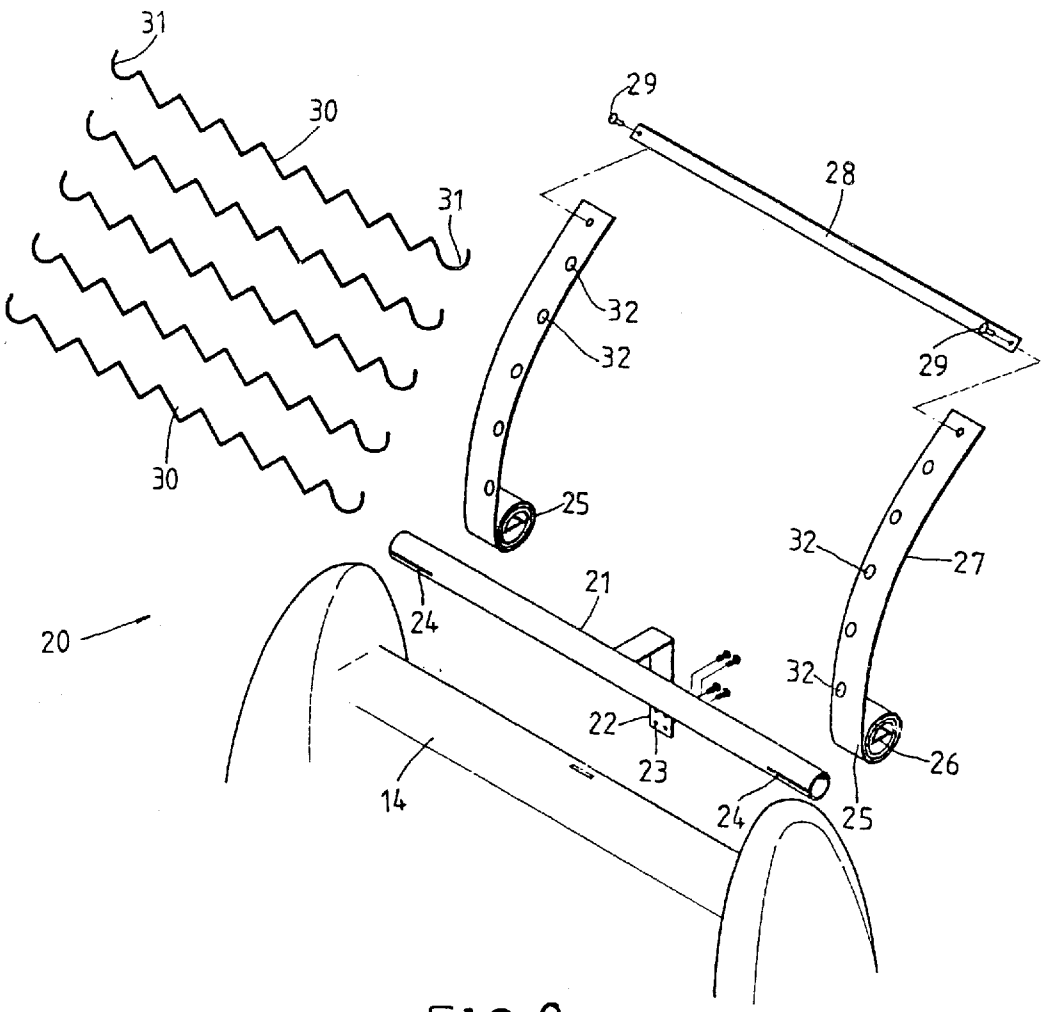
FIG. 8 shows an exploded view of a rotating device of the present invention.
Figure 9:
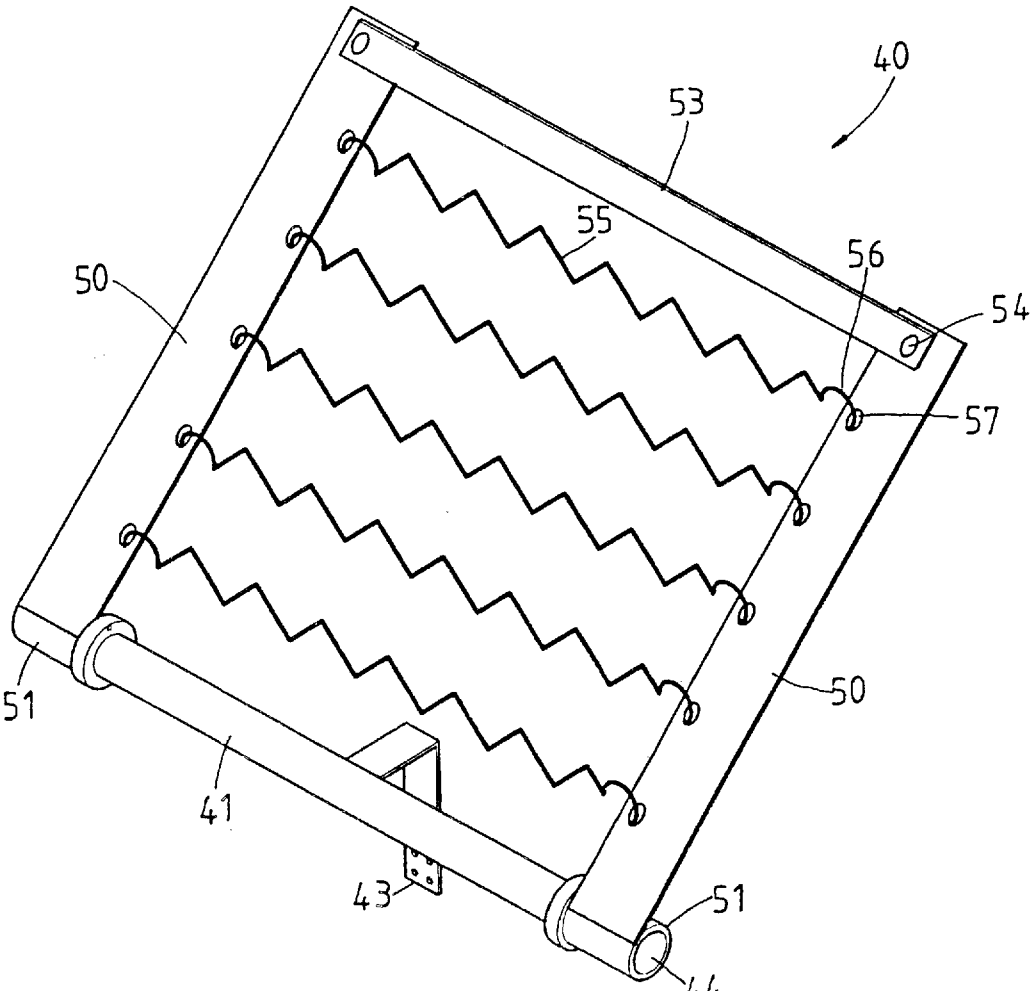
FIG. 9 shows a perspective view of the rotating device of the present invention in combination.

The swiveling device 20 may be replaced by a pivoting device 40. As shown in FIGS. 8 and 9, the pivoting device 40 includes of the components parts, which are described hereinafter.

A rod member 41 is provided with a bracing plate 43 fastened therewith by welding. The bracing plate 43 has a threaded hole 42. The rod member 41 is provided respectively at both ends 44 thereof with an arresting ring 45 which is provided with an insertion hole 46.

Two torsion springs 47 are fitted over both ends 44 of the rod member 41 and are provided with an insertion end 48, which is engaged with the insertion hole 46 of the arresting ring 45. The torsion springs 47 are further provided with a rotating end 49.

Two elastic plate members 50 are similar in profile to the headrest 13 or the backrest pad 18 and are provided respectively with a sleeve 51 fastened therewith such that the sleeve 51 is in an intimate contact with the arresting ring 45 of the rod member 41. The sleeve 51 is provided with a locating slot 52 for retaining the rotating end 49.

A connection rod 53 is fastened between the top ends of the two elastic plate members 50 by two rivets 54.

A plurality of resilient members 55 are provided respectively at both ends thereof with a hooked portion 56, which is engaged with a retaining hole 57 of the elastic plate member 50.

The pivoting device 40 is capable of causing the headrest 13 and the backrest pad 18 to swivel in response to the sitting posture of a person seated on the seat 11.

The embodiments of the present invention described above are to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A chair comprising a seat;

a backrest connected to said seat;

a headrest; and a swiveling device connected to the backrest and the headrest so as to cause the headrest to swivel relative to the backrest in response to a sitting posture of a person seated on the seat, the swiveling device comprises:

a tubular member interconnected to the headrest and provided with a bracing plate fastened thereto such that said bracing plate is inserted into a back plate attached to said backrest, said back plate being fastened to said bracing plate by a fastening screw engaged with a threaded hole of said bracing plate, said tubular member further provided respectively at both ends thereof with a holding slot;

two volute elastic plate members each having an end plate section and an arcuate plate section, said end plate section received in said holding slot of said tubular member, said arcuate plate section said end plate section having a plurality of retaining holes formed therein;

a connection rod fastened to said arcuate plate section of each said volute elastic plate members; and a plurality of elastic members provided respectively at both ends thereof with a hooked portion, said hooked portion being engaged with a respective retaining hole of said plurality of retaining holes of said arcuate plate section of said volute elastic plate members.

2. The chair as defined in claim 1, wherein said backrest is provided with a slotted frame and a backrest pad fastened at one end thereof with an edge of said slotted frame; and wherein said swiveling device is fastened with an edge of said slotted frame of said backrest.

3. A chair comprising:

seat;

a backrest connected to said seat;

a headrest; and a pivoting device connected to said backrest and said headrest so as to cause said headrest to swivel relative to said backrest in response to a sitting posture of a person seated on said seat, said pivoting device comprises:

a rod member interconnected to said headrest and provided with a bracing plate fastened to a back plate of said backrest, said back plate being fastened to said bracing plate by a fastener engaged within a threaded hole of said bracing plate, said rod member provided respectively at both ends thereof with an arresting ring having an insertion hole;

two torsion springs fitted over both ends respectively of said rod member and provided respectively with an insertion end which is engaged with said insertion hole of said arresting ring of said rod member, said torsion springs further provided respectively with a rotating end;

two elastic plate members provided respectively with a sleeve fastened therewith such that said sleeve is in intimate contact with said arresting ring of said rod member, said sleeve provided with a locating slot for receiving said rotating end of said torsion springs, each of said elastic plate members having a plurality of retaining holes formed therein;

a connection rod fastened between said two elastic plate members; and a plurality of resilient members each provided at both ends thereof with a hooked portion which is engaged respectively with a retaining hole of said plurality of retaining holes of said elastic plate members.

4. The chair as defined in claim 3, wherein said backrest is provided with a slotted frame and a backrest pad fastened at one end thereof with an edge of said slotted frame; and wherein said pivoting device is fastened with an edge of said slotted frame of said backrest.

* * * * *